United States Patent [19]

Pal et al.

[11] Patent Number: 4,688,724

[45] Date of Patent: Aug. 25, 1987

[54] LOW PRESSURE MISTING JET

[75] Inventors: Uday B. Pal, Monroeville; Ralph E. Snyder, Export, both of Pa.

[73] Assignee: Allegheny Ludlum Corporation, Pittsburgh, Pa.

[21] Appl. No.: 734,000

[22] Filed: May 14, 1985

[51] Int. Cl.[4] ..... B05B 7/06; B05B 7/04; F23D 11/10

[52] U.S. Cl. ..... 239/424; 239/423; 239/434.5

[58] Field of Search ..... 239/428.5, 434.5, 425.5, 239/424, 423, 421, 419.5, 704–706

[56] References Cited

U.S. PATENT DOCUMENTS

| | | | |
|---|---|---|---|
| 1,986,716 | 7/1934 | Smith | 239/428.5 |
| 3,326,182 | 6/1967 | Inoue | 239/705 X |
| 3,660,933 | 5/1970 | Wong, Jr. | 239/428.5 |
| 3,802,625 | 4/1974 | Buser et al. | 239/704 |
| 3,942,724 | 3/1976 | Mocarski | 239/434.5 |
| 4,210,534 | 7/1980 | Molvar | 239/424 |
| 4,335,854 | 6/1982 | Reynoso | 239/428.5 |

OTHER PUBLICATIONS

"Misting Jet", I.R.M., Industry Research and Metallurty; Division of C.R.M.— Benelux.

"Air Mist Cooling on Slab Casters", by F. William Zurlich.

Advertisement for Spraco, a Lechler Company, for its "Air Mist" Nozzle.

*Primary Examiner*—Andres Kashnikow

*Assistant Examiner*—Patrick N. Burkhart

*Attorney, Agent, or Firm*—Patrick J. Viccaro

[57] ABSTRACT

A misting jet apparatus is provided for producing an air-water mist comprising a water nozzle that produces an expanding stream of water droplets which enters an air-mixing nozzle wherein air introduced to said mixing nozzle converts the expanding stream of water droplets into an air-water mist which exits as a jet having high cooling capacity at relatively low air pressures, and is adapted for metallurgical quenching applications.

9 Claims, 3 Drawing Figures

LOW PRESSURE MISTING JET

BACKGROUND OF THE INVENTION

This invention relates to cooling jet apparatus which use a mixture of liquid and gas for cooling or quenching. More particularly, it relates to misting cooling jet nozzles which are operable at relatively low gas pressure while providing relatively high cooling capacity.

In the manufacturing and processing of many types of products, it may be necessary to subject the workpiece to heating and cooling processes, particularly in continuous operations. Cooling may be accomplished in numerous ways, including providing a cooling or quenching fluid jet which is applied to the workpiece surface. The cooling or quenching jet may involve the use of gases, liquids, or mixtures of gases and liquids. Air and inert gases are commonly used gases and water and oils are commonly used liquids for use in cooling or quenching jets. As used herein, all references to "air" include and mean any and all suitable gases, generally, and all references to "water" include and mean any and all suitable liquids, generally.

In various metallurgical applications, such as at the exit end of an annealing furnace or in continuous metal-casting operations, it is necessary to produce a cooling or quenching jet which is applied to the surface of an alloy workpiece. Cooling or quenching in these applications may involve the application of air or water, and where more drastic cooling action is required, it is known to employ mist cooling. Mist cooling involves the use of air under high pressure to form a mist by ejecting water at high speed from a nozzle with air. The cooling capacity of the resulting mist jet is determined by the momentum of the jet and the air/water ratio of the mist comprising the jet. In conventional misting jet systems, most of the energy of the pressurized air is consumed in forming the mist with only the remaining energy being used to produce the mist jet impact. Typically, conventional nozzle designs provide for air and water to enter the nozzle mixing chamber at near right angles such that the air must move and accelerate the water from a zero or low velocity to a discharge velocity in the direction of the jet.

As used herein, all references to "pressures" include and mean differential pressures, unless otherwise stated.

What is needed is a misting jet nozzle which is operable at relatively low air pressures, on the order of less than 10 psi (68.95 kPa), while providing a relatively high cooling capacity. It is a primary object of the present invention to provide such a misting jet nozzle. The nozzle should also provide varying and different cooling rates, as may be required, by regulating primarily the water pressure. It is also desirable to provide a nozzle having a design which facilitates formation of water droplets for mist cooling.

SUMMARY OF THE INVENTION

In accordance with the present invention a misting jet apparatus is provided comprising an air-water mixing nozzle having an entry end and an exit end, a water nozzle having a first opening and a second opening for water under pressure to enter and exit the water nozzle, respectively. The water nozzle includes a means in association with the second opening for producing an expanding stream of water droplets from the second opening and into the mixing nozzle. The apparatus includes a means for introducing air under pressure to the mixing nozzle to convert the expanding stream of water droplets in the mixing nozzle into an air-water mist which leaves the exit end of the mixing nozzle as a jet.

DETAILED DESCRIPTION OF THE PREFERRED EMBODIMENTS

Figure 1:
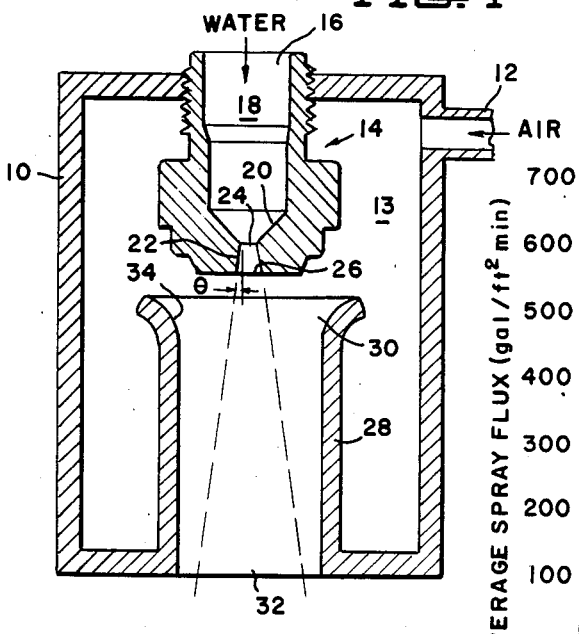
FIG. 1 is a sectional view of one embodiment of a misting apparatus in accordance with the invention.

FIG. 1 illustrates one embodiment of a misting jet nozzle apparatus of the present invention. The apparatus includes a housing 10 having an air inlet 12 and a water nozzle 14 that is axially aligned with an air-water mixing nozzle 28 from which a cooling jet of air-water mist is discharged.

In accordance with the invention, a mist jet apparatus is provided wherein a relatively low capacity air pump, for example on the order of 3 to 4 psi (20.7 to 27.6 KPa) may provide on the order of 24.5 standard cubic feet per minute, SCFM, (0.69 $m^3$/min) of air for applications where a relatively mild air cooling is required. In addition, the same apparatus or system, including the same air pump, produces at least 21 SCFM (0.60 $m^3$/min) of air along with a water flow exceeding 1.1 gallons per minute, GPM, for more severe cooling application requiring the use of an air-water mist cooling jet. This is achieved, in accordance with the invention, by mist jet apparatus wherein the energy of the water introduced to the apparatus is used therein to generate an expanding stream of fast moving water droplets, which stream is then contacted with air to form the desired mist jet for cooling. In contrast with conventional apparatus requiring at least 10 psi (68.95 kPa) and typically more than 20 psi (137.9 kPa) of air pressure for typical cooling applications, the present invention can operate effectively with on the order of only 3 psi of air pressure.

Broadly in accordance with the invention, the misting jet apparatus thereof comprises a water nozzle having a first opening therein for introduction of water under pressure to the nozzle. A second water exit opening is provided in the water nozzle. Means are provided in association with the second opening for producing an expanding stream of water droplets that exit from the water nozzle and enter an air-water mixing nozzle. In the air-water mixing nozzle, air under pressure is introduced to convert the expanding stream of water droplets into an air-water mist which is discharged from the mixing nozzle as a jet of air-water mist adapted for cooling applications, such as metallurgical quenching. The expanding stream of water droplets from the water nozzle is produced within the water nozzle from a chamber into which the water is introduced under pressure and from which it passes into and through a flared bore communicating with and extending from the chamber and to a water exit opening. The bore is flared from the water chamber to the exit opening of the water nozzle so that the opening in the bore closest to the water chamber is of a relatively smaller size or diameter than the water exit opening at the opposite end of the flared bore. This structure, with the water under pressure, produces an expanding stream of water droplets which enter the air-mixing nozzle. The flared bore and the air-water mixing nozzle are in spaced-apart relation and adapted to maintain the expanding stream of water droplets entering the mixing nozzle out of contact with interior surfaces thereof. In this manner, the energy of the stream of water droplets is not diminished by surface contact with the air-water mixing nozzle.

An embodiment of a misting jet apparatus of the present invention, as shown in FIG. 1, includes a housing 10 having therein an air inlet 12 to provide air to an air chamber or plenum 13 of housing 10. Preferably, plenum 13 extends about all or portions of the periphery of entry end portion 30 of air-water mixing nozzle 28 adjacent bore 22 of water nozzle 14 to provide air to mixing nozzle 28.

Housing 10 also includes water nozzle 10 which includes an opening 16 into which water is introduced to chamber 18. Chamber 18 may have any of various shapes, and preferably may be of generally cylindrical construction. Chamber 18 may have a conical bottom portion 20 terminating in a flared bore 22 to facilitate water flow through water nozzle 14. Flared bore 22 has a smaller size or diameter opening 24 communicating with chamber 18 and a larger size or diameter opening 26 communicating with the exterior of water nozzle 14. Bore 22 requires only a slight flare of a few degrees to facilitate producing an expanding stream of water droplets. Preferably, the flare angle, $\theta$, as measured from the axis of bore 22 may be less than 5°, and more preferably about 3°. It is to be understood that the angle and depth of flared bore 22 is dependent upon the size and construction of other structural elements of the misting jet apparatus, as explained herein.

An air-water mixing nozzle 28 of housing 10 may be in substantial axial alignment with water nozzle 14. Preferably, bore 22 of water nozzle 14 is in substantial axial alignment therewith. Air-water mixing nozzle 28 may be in the form of an elongated tubular member, preferably, as an elongated cylinder as shown in FIG. 1, or as an elongated tubular member having a smaller size diameter opening at exit end 32 than at end 30. The reduction in size at end 32 may be provided in various manners, such as by a gradual tapering, or by restricting or necking exit end 32, for example, to further control discharge flow and ejection velocity. The size and shape of mixing nozzle 28 must be sufficiently large so that the expanding stream of water droplets from bore 22 and entering mixing nozzle 28 are maintained essentially out of contact with, and preferably in no contact with, the interior surfaces of mixing nozzles 28.

Entry end 30 of air-water mixing nozzle 28 should also be sufficiently large to allow the entry of air into the mixing nozzle 28. Preferably, entry end 30 includes an enlarging flare 34, as shown in FIG. 1, to permit smooth directional entry of air into mixing nozzle 28 adjacent the expanding stream of water droplets from bore 22 of water nozzle 14.

In the operation of the misting jet apparatus of FIG. 1, air is introduced to the chamber 10 through air inlet 12. Simultaneously, water (not shown) is introduced to water nozzle 14, and specifically chamber 18 thereof, through opening 16. The water under pressure enters the bore 22 through opening 24 and is converted by the flare of the bore in combination with the pressure of the water into an expanding stream of water droplets which exits through opening 26 and enters air-water mixing nozzle 28. The degree of flare of the bore 22, the distance of exit end 32 of the mixing nozzle 28, which is furthest from the water nozzle 14, and the diameter of the mixing nozzle 28 interior are adjusted to insure that the expanding stream of water droplets does not contact the interior surfaces of the mixing nozzle 28. Air entering the nozzle 28 along with the water fills the voids between the droplets in the expanding stream and serves to generate the desired mist jet. Since the water is already in the form of droplets upon entering the nozzle 28, less air pressure is required than is typical of conventional misting jets to form the desired mist. As the mist jet exits from the nozzle 28, it may be directed onto a surface of a workpiece for cooling purposes.

EXAMPLE I

To demonstrate the present invention, a misting jet apparatus of FIG. 1 was made with water nozzle 14 having a 0.078-inch diameter bore 22 in the inlet end 24. The flare of bore 22 was about 3°. Air-water mixing nozzle 28 had a 0.5 inch diameter and a length of 2 inches from end 30 to exit end 32. Mixing nozzle 28 at exit end of bore 22 and water nozzle 14 were axially aligned and separated by about 0.125 inch. The misting jet apparatus was operated at a water flow of 1.5 GPM ($5.68\times10^{-3}$ $m^3$/min) at 45 psi (310 kPa) and at an air flow of 20 SCFM (0.57 $m^3$/ min) at a pressure of 3 psi (20.7 kPa).

Figure 2:
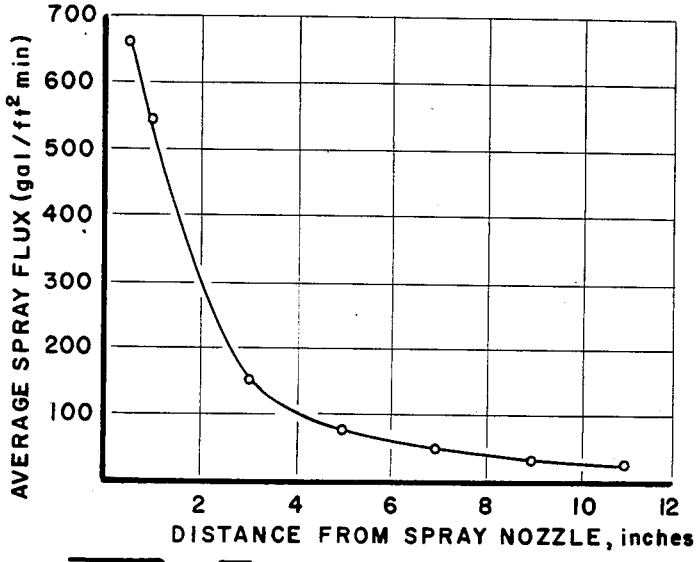
FIG. 2 is a curve showing the spray flux average through the cross section of a misting jet in accordance with the invention as a function of the distance of the jet from the apparatus.

The spray pattern generated by the embodiment of the invention described above and shown in FIG. 1 is in the form of a cone. In demonstrating the invention, the flux of spray water in gallons per square foot per minute was measured at different distances from the nozzle exit. It was determined that the flux at a spray center is approximately twice that at the spray boundary. The average flux recorded across the spray cross section as a function of the distance of the nozzle from the workpiece is shown by the curve in FIG. 2. The curve of FIG. 2 appears to be typical of the misting jet apparatus of the present invention, for other air and water combinations have demonstrated similar curves.

EXAMPLE II

To demostrate the cooling characteristics of the misting jet of the present invention of Example I, samples of Type 301 stainless steel, 0.08-inch (0.2 cm) thick plate were sprayed at a distance of from 9 to 10 inches (22.9 to 25.4 cm) for steel plate in the temperature range of 1900° to 900° F. (1038° to 482° C.). A compilation of experimental trials at various water and air flows and water and air differential pressures, and average heat transfer coefficients over that temperature range are shown in the following Table.

TABLE

| Test No. | Water Flow in Nozzle (GPM) | Water Pressure (psi) | Air Flow in Nozzle (SCFM) | Air Pressure (psi) | Average Heat Transfer Coefficient (Btu/Hr/Ft2/°F.) |
|---|---|---|---|---|---|
| 1 | 0.9 | 25 to 30 | 22.5 | 3.0 | 331 |
| 2 | 1.1 | 30 to 35 | 21.5 | 3.0 | 420 |
| 3 | 1.3 | 40 to 45 | 20.5 | 3.0 | 520 |
| 4 | 1.5 | 45 to 50 | 20.0 | 3.0 | 505 |
| 5 | 0.9 | 25 to 30 | 27.0 | 4.0 | 332 |
| 6 | 1.25 | 30 to 35 | 26.0 | 4.5 | 485 |
| 7 | 1.35 | 40 to 45 | 25.0 | 4.5/5.0 | 500 |
| 8 | 1.5 | 45 to 50 | 24.0 | 4.5/5.0 | 550 |

The data of the Table resulting from tests of the misting jet apparatus of the invention indicates that the performance is comparable to and in some instances better than with conventional misting jet apparatus while using air at significantly lower pressures than with these conventional apparatus. This demonstrates that the device of the invention can generate a mist with a high cooling capacity comparable to the cooling capacity produced with conventional apparatus but at significantly lower air pressure of less than 10 psi (68.95 kPa) and preferably less than 5 psi (34.5 kPa).

Figure 3:
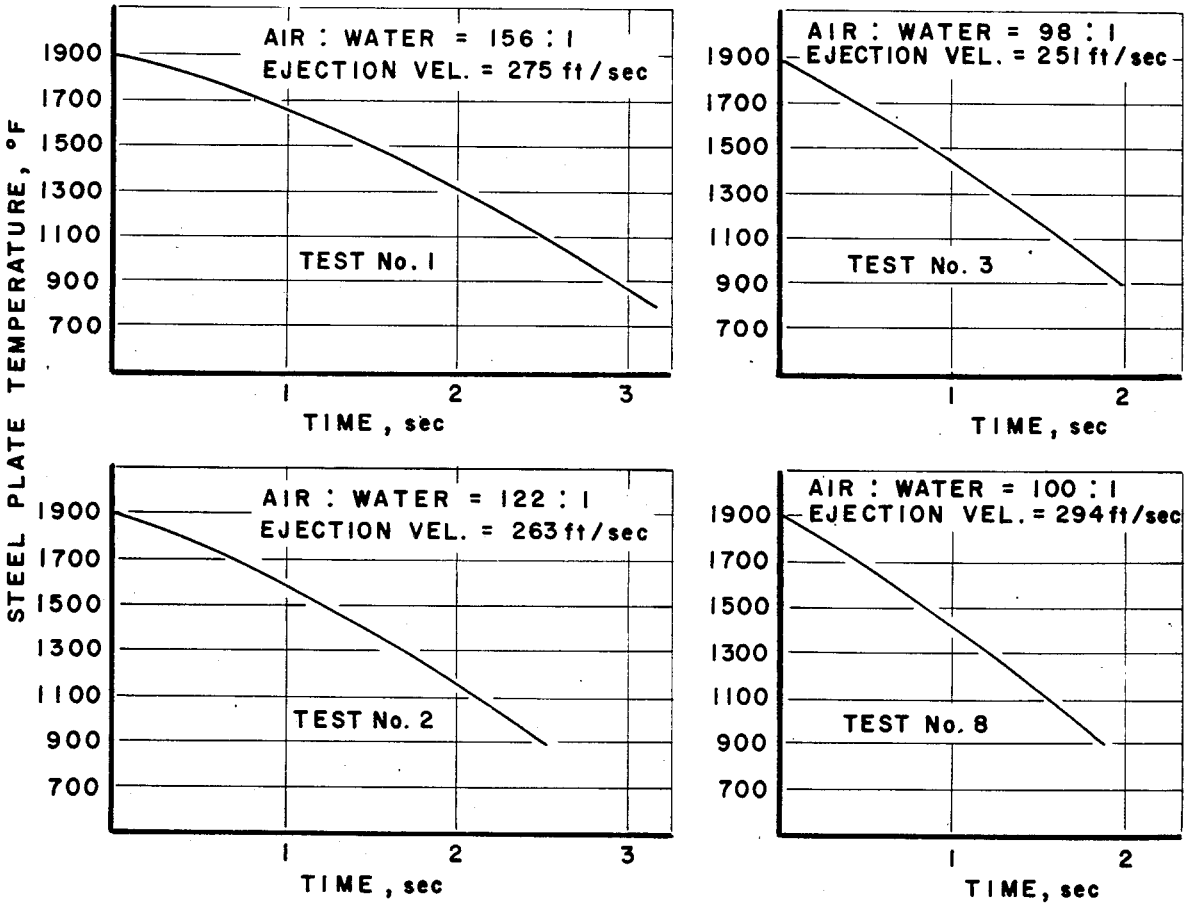
FIG. 3 is a series of curves demonstrating the effects of air-to-water ratio and mist jet momentum on the cooling rate of various test samples.

The cooling characteristics of the misting jet are dependent on the volumetric ratio of air-to-water in the misting jet and the momentum of the mist jet at the exit from the mixing nozzle. FIG. 3 is a series of curves demonstrating the effects of air-to-water ratio and mist jet momentum on the cooling rate of the samples of Example I for Test Nos. 1, 2, 3, and 8.

It has been found that for the misting jet apparatus of the present invention, the water pressure does not in any way influence the entry pressure of the air. In other words, the energy of the water, which is used to produce the expanding stream of water droplets, is independent of the air pressure. It has been further found that different and variable cooling rates can be provided by the present invention by controlling the water, and specifically the water pressure. By the apparatus, variable cooling rates can be provided more easily and economically by controlling water pressure and requiring only on the order of one-third ($\frac{1}{3}$) of the air energy of conventional misting jets. An advantage of the apparatus of the present invention is that it is suitable for applications requiring the ability to obtain relatively high cooling capacity at a variety of cooling rates, such as on large scale operations, economically at low air pressures.

Although preferred and alternative embodiments have been described, it will be apparent to one skilled in the art that changes can be made therein without departing from the scope of the invention.

What is claimed is:

1. A misting jet apparatus for producing an air-water mist, said apparatus comprising an air-water mixing nozzle having an entry end and an exit end;

a water nozzle having a first opening therein for introduction of water under controlled pressure to said nozzle, a second opening therein for water to exit, and means in association with the second opening for producing an expanding stream of water droplets which exit said water nozzle from the second opening and enter said mixing nozzle;

said means for producing the expanding stream of water droplets from said water nozzle and said air-water mixing nozzle being aligned so that there is essentially no contact of the water droplets with the interior surfaces of said mixing nozzle; and means for introducing air under pressure of less than 10 psi to said mixing nozzle to fill the voids between the water droplets to convert the expanding stream of water droplets in said mixing nozzle into an air-water mist which leaves the exit end of said mixing nozzle as a jet, the air pressure being independent of the water pressure.

2. The apparatus of claim 1 wherein the means in association with the second opening of said water nozzle for producing an expanding stream of water droplets is in substantial axial alignment with said air-water mixing nozzle.

3. The apparatus of claim 1 wherein said means in association with the second water exit opening of said water nozzle for producing an expanding stream of water droplets includes a chamber within said water nozzle into which said water under pressure from the first opening is introduced, and a flared bore communicating with and extending from said chamber to the second water exit opening with said bore being flared from said chamber to the second water exit opening.

4. The apparatus of claim 3 wherein said flared bore and said air-water mixing nozzle are in spaced-apart relation and adapted to maintain said expanding stream of water droplets exiting said water nozzle and entering said air-water mixing nozzle essentially out of contact with interior surfaces of said mixing nozzle.

5. The apparatus of claim 3 wherein said air-water mixing nozzle is cylindrical positioned axially relative to said flared bore of said water nozzle.

6. The apparatus of claim 1 wherein the exit end of the air-water mixing nozzle has a smaller opening size than the entry end.

7. The apparatus of claim 1 wherein the means for introducing air under pressure to said mixing nozzle includes an enlarged entry end of said mixing nozzle to facilitate entry of air.

8. The apparatus of claim 1 wherein the means for introducing air under pressure to said mixing nozzle provides for air introduction from the periphery of said mixing nozzle.

9. A misting jet apparatus for producing an air-water mist, said apparatus comprising an air-water mixing nozzle having an entry end and an exit end, said entry end being enlarged to facilitate entry of air;

a water nozzle having a first opening therein for introduction of water under controlled pressure to said nozzle, a second opening therein for water to exit, and means in association with the second water exit opening for producing an expanding stream of water droplets which exit said water nozzle from the second opening and into the entry end of said mixing nozzle;

said means for producing the expanding stream includes a chamber within said water nozzle into which water under pressure from said first opening is introduced, and a flared bore communicating with and extending from said chamber to the second water exit opening, said bore being flared from said chamber to the second water exit opening;

said means for producing the expanding stream being in substantial axial alignment with said air-water mixing nozzle and in a spaced relation to maintain the expanding stream of water droplets from said water nozzle and entering said mixing nozzle essentially out of contact with the interior surfaces of said mixing nozzle and;

means for introducing air under pressure of less than 10 psi to said mixing nozzle from the periphery thereof to convert the expanding stream of water droplets in said mixing nozzle into an air-water mist which leaves the exit end of said mixing nozzle as a jet, the air pressure being independent of the water pressure.

* * * * *